United States Patent [19]

Ingalsbe et al.

[11] Patent Number: 4,792,016

[45] Date of Patent: Dec. 20, 1988

[54] LADDER SECURING DEVICE

[75] Inventors: Daryl E. Ingalsbe, Blair, Nebr.; David L. Ingalsbe, Northfield, Minn.; Arlen G. Bourn, Omaha, Nebr.

[73] Assignee: Independent Technologies, Inc., Omaha, Nebr.

[21] Appl. No.: 122,020

[22] Filed: Nov. 17, 1987

[51] Int. Cl.[4] ..... E06C 5/36

[52] U.S. Cl. ..... 182/107; 182/93; 24/170

[58] Field of Search ..... 182/107, 9, 93, 229, 182/230, 3–8; 24/170

[56] References Cited

U.S. PATENT DOCUMENTS

| | | | |
|---|---|---|---|
| 3,678,542 | 7/1972 | Prete | 24/170 |
| 4,169,518 | 10/1979 | Schmoock | 182/8 |
| 4,545,460 | 10/1985 | Byrd | 182/107 |
| 4,667,772 | 5/1984 | Kammerer | 182/6 |

*Primary Examiner*—Reinaldo P. Machado
*Attorney, Agent, or Firm*—Anthony G. Eggink

[57] ABSTRACT

A ladder securing device for securing a ladder to a utility pole or the like. The ladder securing device has a main elongated and flexible strap member having looped ends, with one end forming a hand loop for the user of the device. A quick release adjustment buckle is provided for adjustably engaging the main strap member. An elongated, flexible buckle strap is secured to the adjustment buckle at one end and which has a loop at its opposite end. A pair of hooks are provided for engaging the rail of the ladder. One hook is attached to the end of the main strap member opposite the hand loop and the other hook is attached to the buckle strap at the end opposite its attachment to the buckle. The device, when placed in an X-configuration about a utility pole and with the hooks attached to the rails of the ladder, permits the quick securement of the ladder to a utility pole by pulling on the hand loop. Ladder securing device constructions are provided, as well as method steps utilizing the devices to safely secure a ladder to utility poles or the like, for subsequent safe and stable use.

20 Claims, 3 Drawing Sheets

LADDER SECURING DEVICE

BACKGROUND OF THE INVENTION

This invention relates to a ladder securing device for securing a ladder to a utility pole or the like. Particularly, this invention deals with a securing device for indoor and outdoor use to quickly and efficiently secure a ladder, for subsequent stable and safe use.

The effective securement of ladders in both indoor and outdoor situations has been a long recurring problem. Many industries, such as telephone installation and repair services, require their employees to safely secure ladders before use. Although devices to secure ladders are known, these devices have suffered many problems because of their complexity and their difficulties of use.

Prior art devices have typically required the use of ropes to secure ladders to a utility pole, for example, but rope-type devices and methods utilizing them are very time consuming and therefore, have not been faithfully utilized by the user. Other devices have required the use of bulky elements which are attached to the top portion of a ladder and which, therefore, provide limited ladder securement or stabilization. Other devices have provided complex devices that are difficult to manufacture and, more importantly, difficult to use and, therefore, have not been faithfully utilized by the users of the devices.

Although a number of prior art devices have been utilized or proposed to physically secure ladders to permanent and secure surroundings, these devices have not only been tedious and difficult to attach, but they have also been difficult to remove after use. For example, the utilization of rope-type devices and those employing snap-on securement buckles are extremely difficult to unfasten and remove. The latter devices often times require the physical movement of the ladder towards the utility pole, for example, to produce enough slack in the securement device to permit its detachment. The required physical movement of a ladder imbedded in soil or mud after use has resulted in lower back injuries to users and consequently has resulted in sporadic use of these devices. Despite the longstanding need for a safe, effective, and quick to use ladder securement device for a variety of indoor and outdoor settings, none insofar as is known, has been developed.

The ladder securing device of this invention is provided to overcome the problems and limitations associated with these prior art devices. Additionally, methods taught by this invention provide users with sequential steps to quickly and securely fasten ladders to support structures in both indoor and outdoor settings and, particularly, against utility poles.

SUMMARY OF THE INVENTION

The invention provides a ladder securing device for securing a ladder to a utility pole or the like. The ladder securing device has a main elongated and flexible strap member having looped ends, with one end forming a hand loop for the user of the device. A quick release adjustment buckle is provided for adjustably engaging the main strap member. An elongated, flexible buckle strap is provided having a length substantially shorter than the main strap member and which is secured to the adjustment buckle at one end and having a loop at its opposite end.

A pair of hooks are provided for engaging the rails of the ladder, one hook is attached at the end of the main strap member opposite the hand loop and the other hook is attached to the buckle strap at the end opposite its attachment to the adjustment buckle. The device when placed in an X-configuration about a utility pole and with the hooks attached to the rails of the ladder secures the ladder to the utility pole by pulling on the hand loop.

Also provided by the ladder securing device are materials from which the main strap and other strap members of this device are constructed. Additionally provided by the invention are device lengths and sizes as well as material construction tolerances for the elements of the ladder securing device. And further provided by this invention are the use of quick release buckle devices and other elements of the device so that a ladder, can be quickly and securely placed, as well as quickly and safely detached in both indoor and outdoor settings.

Further provided by the teachings of this invention are methods to utilize ladder securing devices to quickly and safely secure and detach a ladder to utility poles or the like for subsequent safe and stable use.

These and other benefits of this invention will become clear from the following description, by reference to the drawings.

DESCRIPTION OF THE PREFERRED EMBODIMENTS

Figure 3:
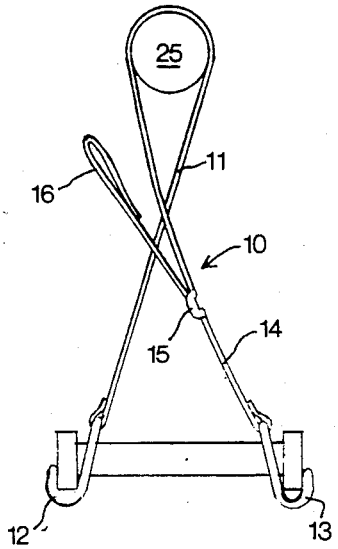

Referring to the drawings, the ladder securing device 10 is shown to have a main strap 11 and a pair of hooks 12 and 13. As further shown, a quick release buckle 15 is utilized and which joins the buckle strap 14 and the main strap 11. As shown in FIG. 3, hook 13 is attached to a buckle strap 14, which is attached to the quick release buckle 15. At the end of the main strap 11 is a hand loop 16 for grasping by the user to operate the device 10.

Figure 6:
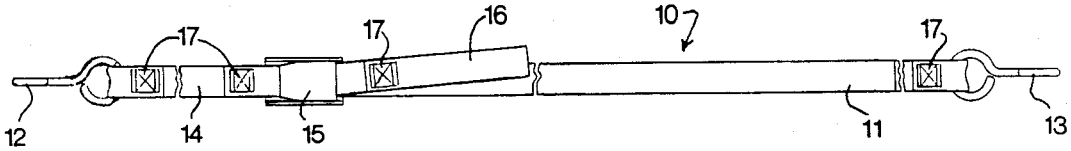
FIG. 6 is a top plan view of the ladder securing device of this invention.
Figure 7:
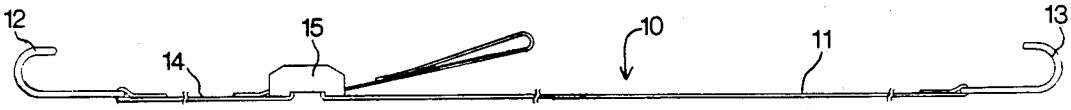
FIG. 7 is a lateral plan view of the ladder securing device shown in FIG. 6.

FIGS. 6 and 7 further show the elements of the ladder securing device 10. The hooks 12 and 13 are attached to the main strap 11 and buckle strap 14, respectively, by means of a stitching pattern 17. Further, the buckle strap 14 is attached to the quick release buckle 15 by means of a loop in the strap body which is also stitched at 17 as shown in FIG. 6. Additionally, the hand loop 16 is shown to be stitched at 17 to form a hand loop for use by the user.

Figure 8:
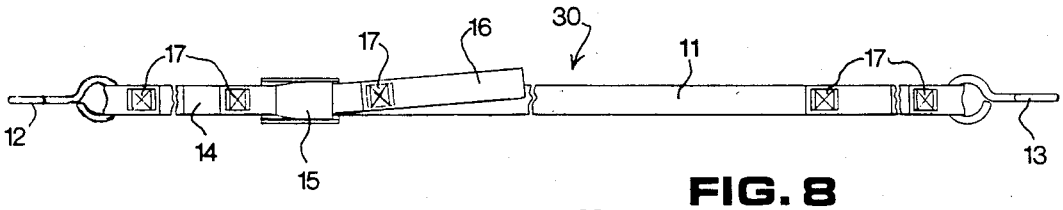
FIG. 8 is a top plan view of an alternate embodiment of the ladder securing device of this invention.
Figure 9:
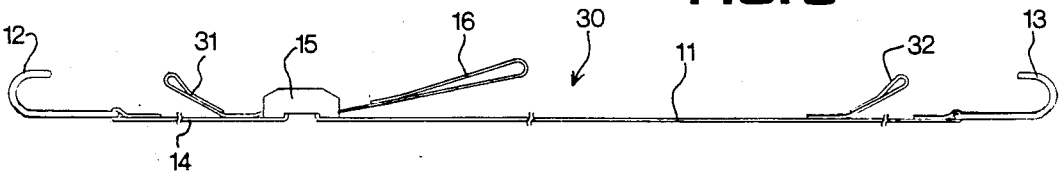
FIG. 9 is a lateral plan view of the ladder securing device shown in FIG. 8.

FIGS. 8 and 9 show an alternative embodiment 30 of the ladder securing device of this invention. As shown, the device 30 similar to that shown in FIGS. 6 and 7 additionally has hook-loops 31 and 32 attached respectively to the buckle strap 14 and the main strap 11. This configuration permits a user to secure the uprights of a ladder by means of placing the tips of hooks 12 and 13 respectively through the hook-loops 31 and 32, thereby securing the ladder securing device 10 to the ladder. This particular embodiment, may be useful for certain types of securement situations and provides a user with an alternative means for utilizing the device.

Figure 10:
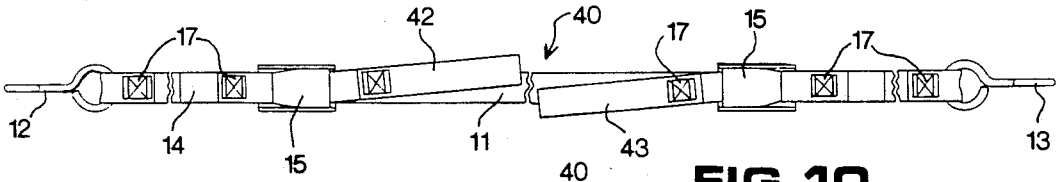
FIG. 10 is a top plan view of another embodiment of the ladder securing device of this invention.
Figure 11:
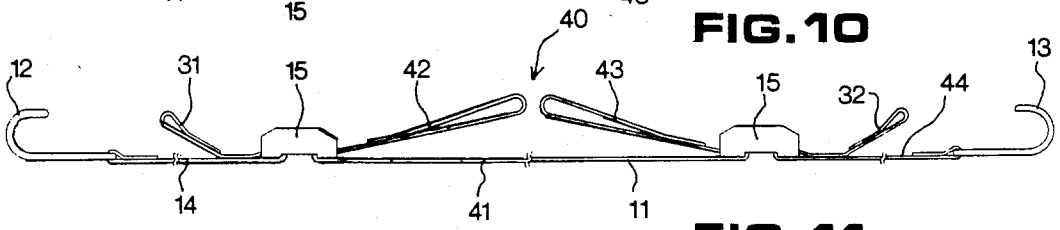
FIG. 11 is a lateral plan view of the ladder securing device shown in FIG. 10.

FIGS. 10 and 11 show another embodiment 40 of the ladder securing device. As shown, the hooks 12 and 13 are respectively attached to the buckle strap 14 and to the terminal end 44 of strap 11. The buckle strap 14 and end strap 40 are each secured to the quick release buckles 15. The adjustment means utilized in this embodiment involve a central strap portion 41 of main strap 11 which adjustably engages both of the buckles 15 and which has terminal hand loops 42 and 43. This particular embodiment 40 also permits a user to utilize the hooks 12 and 13 with the respective hook-loops 31 and 32. Additionally, a pair of hand loops 42 and 43 are provided so that the user can properly position the ladder with respect to the utility pole by utilizing two adjustment buckles 15.

Figure 12:
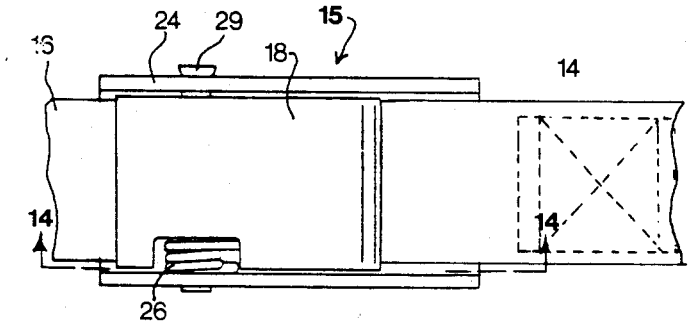
FIG. 12 is a top plan view of the quick release buckle used in the ladder securing device of this invention.
Figure 13:
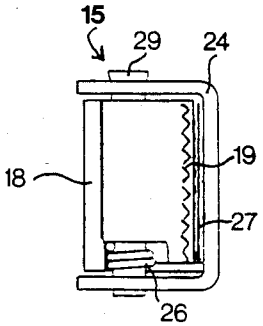
FIG. 13 is a rear plan view of the quick release buckle shown in FIG. 12.

FIG. 12 is a top view of the quick release buckle 15 utilized in the ladder securing devices of this invention. As shown, the buckle is of the quick release type. The buckle 15 is comprised of a buckle body 24, a spring mechanism 26 mounted on post 24, and a buckle lever 18. FIG. 13 shows an end view of the buckle 15 and which shows the the buckle lever 18 having a latching-type surface 19 and an opposing grooved interior surface 27.

Figure 14:
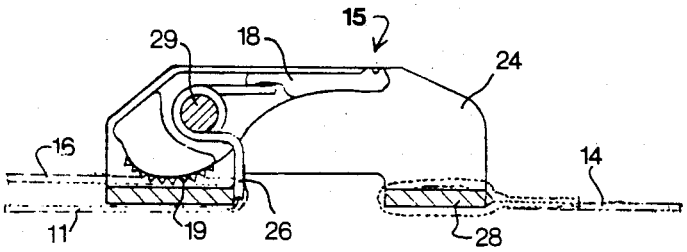
FIG. 14 is a sectional view of the quick release buckle taken along lines 14—14 of FIG. 12.

FIG. 14 shows a section of the buckle 15 shown in FIG. 12. As illustrated, buckle strap 14 is attached about the buckle body portion 28 and the latching surface 19 of lever 18 has a plurality of serrated members which grip and secure the main strap 11 against the interior of the buckle body 24. Thus, in its locked position as shown in FIG. 14 the main strap 11 of the ladder securing device 10 is held in place, while pushing downward on the buckle lever 18 releases the main strap 11 with respect to the buckle 15 for adjustment or for subsequent release purposes after use.

This invention also provides a process for securing a ladder to a utility pole or the like, utilizing the ladder securement devices discussed above. The process steps for securing a ladder are illustrated in FIGS. 2, 3, 4, and 5 of the drawings.

Figure 2:
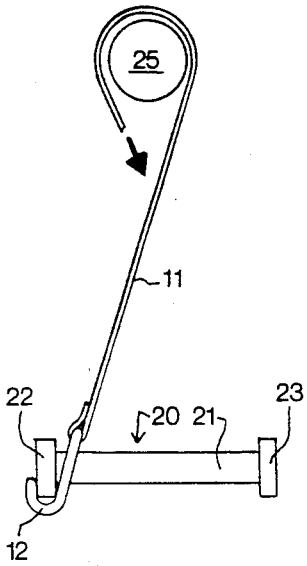
FIGS. 2–5 show the process steps of utilizing the ladder securing device of this invention to secure a ladder to a utility pole.

The process for securing a ladder 20 to a utility pole 25 involves a number of sequential steps. First, the ladder 20 is positioned against the pole 25 at a proper angle and placed on a permanent solid footing. Next, the ladder securing device 10 is extended to a necessary length by releasing the buckle 15 and pulling the main strap 11 back through it until a desired length of strap is obtained. Next, the hook 12 is attached to the inside of the ladder rail 22 under the 5th or 6th rung of the ladder at approximately shoulder height. The tip of the hook 12 should be facing the outside of the ladder rail as shown in FIG. 2. Next, the strap 11 is fed between the ladder 20 and the utility pole 25 as shown in FIG. 2. The strap 11 is singly wrapped about the pole 25 and crossed over itself and then the second hook 13 is attached to the opposite rail 23 under the same rung 21 as the placement of hook 12. This step provides a strap 11 X-configuration between the pole 25 and the ladder 20 as shown in FIG. 3.

Figure 4:
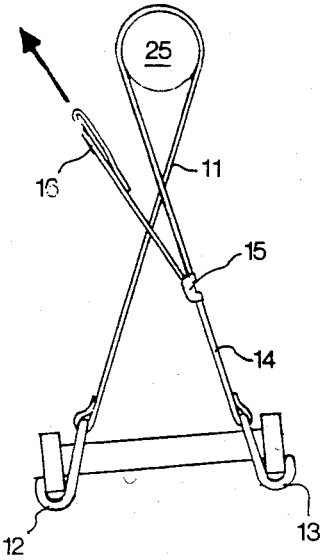
Figure 5:
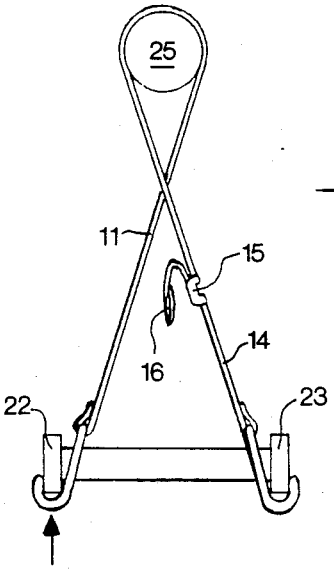

While holding the ladder securing device 10 in place, the hand loop 16 is pulled towards the pole 25 until the strap 11 becomes snug. This action will twist the ladder 20, thereby positioning one rail 23 closer to the pole than the other rail 22 as shown in FIG. 4. Next, the ladder rail 22, which is the furthest from the pole 25, is grasped and pulled toward pole 25, as shown in FIG. 5. This will slide the strap 11 around the pole 25 to correct the twist in the ladder 20 and to equalize the pressure on both ladder rails 22 and 23 as the hand loop 16 is pulled as shown in FIG. 5. The latter two straps, can be repeated until the ladder 20 is held tightly against the pole 25 with both ladder rails 22 and 23 being an equal distance from pole 25. This configuration of the ladder securing device 10 is such, so that an equal pressure is exerted on both ladder rails 22 and 23, and the ladder 20 should be slightly bowed towards the pole 25 before it is utlized as shown in FIG. 1.

Figure 1:
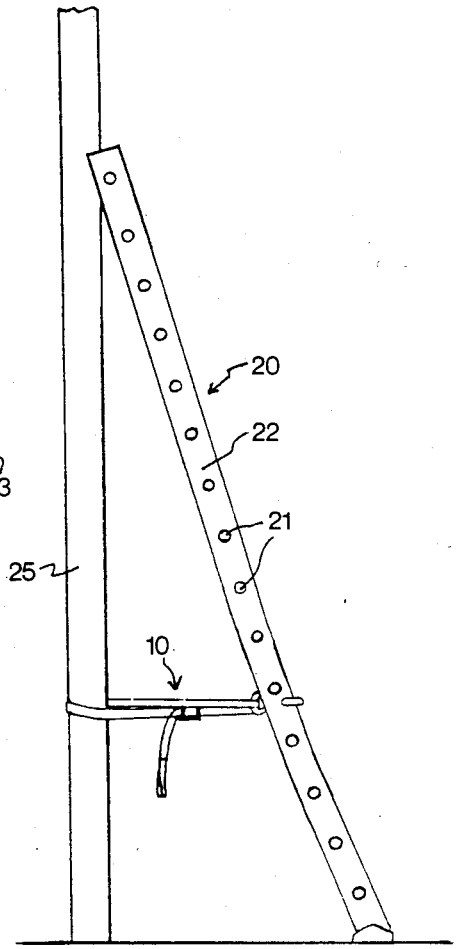
FIG. 1 is a lateral view of the ladder securing device of this invention and shown in use securing a ladder to a utility pole.

To remove the ladder securing device 10 from a position of use as shown in FIG. 1, the quick release, spring loaded buckle 15 is depressed and enough strap 11 is pulled back through the buckle 15 to allow it to be unhooked from the ladder 20 and removed from the pole 25.

The ladder securing device is preferably of a length of approximately 15 to 20 feet, which has been found to be suitable for use in most ladder securing applications. A device length of aproximately 16 feet has been found suitable for most applications. Additionally, the strap members are preferably constructed nylon webbing, or the like, having a width of approximately one to two inches which yields a tensile strength of approxiamtely 1,500 pounds. Straps having a one inch width have been found suitable for most ladder securing applications.

Additionally, the devices, as shown, have stitching to secure the hooks and adjustable buckles to the strap portion, and this stitching likewise preferably yields a structural strength of approximately 1,500 pounds of pull. Although it is within the purview of this invention to utilize nylon webbing for the strap construction, the important result being that the strapping material is able to be stitched or similarly fastened to yield 1,500 pounds of pull and that the strapping material is able to be slid about the rear surface of a utility pole or the like. Additionally, strapping material constructed of nylon webbing or the like, is strong, does not mildew in storage and does not deteriorate.

The strap material can also be provided in varying widths, for example, 2 inches, to meet the requirement of various securement needs. Additionally, it is preferred that the strapping material is of an orange color or internationally regarded safety-orange, so that the ladder securement device is properly recognized and, thus, faithfully used.

Additionally provided by this invention is a quick release type buckle structure having a spring loaded level mechanism. It is also within the purview of this invention to utilize similarly constructed buckles so long as they are of the quick release type, are able to withstand approximately 1,500 pounds of pull force, and are able to grasp the strapping materials used therewith and to hold them in a secure position to yield the required pull experienced in securing ladders.

Importantly, the quick release buckles not only permit the quick and safe securement of the ladder, but they also permit the quick and safe disengagement of the securement device from the ladder. The easy disengagement permits a user to quickly unfasten the ladder from a utility pole, for example, without the requirement of physically lifting the ladder to produce enough slack in the securement device and thus risking lower back injury to the user.

It has been found that a quick release buckle 15 structure of the type described above is preferred for use with the ladder securing device 10. One such quick release buckle 15 of this type usable with one inch wide nylon webbing has a length of approximately 2.75 inches, a width of approximately 1.5 inches and a push-down release lever 18 having a length of approximately 1.5 inches. However, other quick release type buckle structures are within the purview of this invention. The important aspect of these buckle structures is that they are of the quick release type and quickly activatable to release the strap webbing held therein. Additionally, the buckle 15 should have a webbing holding force of at least 1,500 pounds of pull. And, as particularly shown in FIG. 14, the lever 18 is situated in the buckle body 24 so as to prevent unwanted or accidental movement of the lever and consequential release of the strap 11.

With respect to the hook configurations, it has been found that hooks constructed of a metal are well suited for use in the ladder securing devices of this invention. For example, a zinc-plate steel has been found well suited for these purposes. Additionally, the configuration of the hooks should be such that they are able to grasp and surround the rails of a ladder.

It has been found that a zinc plated steel hook 12 structure having a length of approximately six inches and a hook opening of approximately 2.5 inches is useful for most ladder securing applications. However, varying hook 12 dimensions can be utilized with the remaining elements of the ladder securing device 10 for specific applications.

As many changes are possible to the embodiments and processes of this invention, utilizing the techings thereof, the description above and the accompanying drawings should be interpreted in the illustrative, and not in the limited sense.

I claim:

1. A ladder sensing device for quickly securing a ladder having rails and rungs to a utility pole or the like comprising:

(a) first flexible and elongated strap means having opposite ends, said strap means having a flexible and planar body structure of a predetermined width;

(b) adjustable, quick-release strap securement means operative on said first strap means, said quick-release means having a lever;

(c) second flexible and elongated strap means having opposite ends and having a flexible planar body structure of the same said predetermined width, one said end being attached to said quick-release strap securement means; and (d) a pair of rigid hook means being constructed and arranged to engage the rails of a ladder from an interior position, one said hook means being attached to one end of said first flexible strap means and said second hook means being attached to the end of said second flexible strap means opposite said quick-release strap securement means, each said hook means having an opened hook portion and a strap securement portion disposed generally perpendicular thereto, said strap securement portion for securing said first and second strap means in a planar configuration, whereby said device when placed about a utility pole and with said hook means attached to the rails of a ladder easily and quickly secures a ladder to a utility pole or the like by pulling the end of said first flexible strap means opposite said attached hook means by adjustably securing said first flexible strap means in said quick-release strap securement means and whereby said device is easily and quickly disengaged by means of activating said quick-release means level.

2. The ladder securing device of claim 1 wherein said first and second flexible and elongated strap means are constructed of nylon webbing having a width ranging from approximately one to two inches.

3. The ladder securing device of claim 1, wherein said first and second flexible and elongated strap means are of an orange color.

4. The ladder securing device of claim 1, wherein said device has a length ranging from approximately 15 to 20 feet.

5. The ladder securing device of claim 1, wherein said adjustable, quick-release strap securement means is constructed of a quick-release type buckle member having a spring loaded lever mechanism.

6. The ladder securing device of claim 1, wherein said rigid hook means are constructed of a zinc-plated steel.

7. The ladder securing device of claim 1, wherein said first and second flexible and elongated strap means each have a flexible hook-loop secured thereto at a location near said rigid hook means for receiving said rigid hook means and wherein said hook-loops are constructed of the same material as said first and second flexible strap means.

8. The ladder securing device of claim 1, wherein a second adjustable, quick-release strap securement means is provided and being connected to said first flexible and elongated strap means near the attachment of said rigid hook means and wherein said second adjustable strap securement means is constructed and arranged to adjustably receive an intermediate portion of said first flexible and elongated strap means.

9. The ladder securing device of claim 8, wherein said first and second flexible and elongated strap means have flexible hook-loops secured thereto for receiving said rigid hook means.

10. The ladder securing device of claim 1, wherein said rigid hook means and said adjustable strap securement means are attached to said first and second flexible strap means by means of stitching.

11. The ladder securing device of claim 1, wherein said first and second flexible and elongated strap means have a tensile strength of at least 1,500 pounds.

12. The ladder securing device of claim 1, wherein said first flexible strap means has a hand loop opposite said end attached to said hook means.

13. A ladder securing device for quickly securing a ladder having rails and rungs to a utility pole or the like comprising:

(a) a main elongated and flexible strap member having a flexible, planar body and having looped ends, one said end forming a hand loop for the user of said device;

(b) a quick release adjustment buckle having a layer for adjustably engaging said main strap member and for instantaneously disengaging said main strap member by means of said lever;

(c) an elongated and flexible, planar buckle strap having a length substantially shorter than said main strap member and being secured to said buckle at one end and having a loop at its opposite end; and (d) a pair of rigid hooks for engaging the rails of a ladder, each said hook having a strap securement portion, one said hook being planarly attached at said strap securement portion to said looped end of said main strap member opposite said hand loop and the other said hook being planarly attached to said buckle strap at said strap securement portion to the looped end opposite said buckle, whereby, said device when placed about a utility pole and with said hooks attached to the rails of the ladder secures the ladder to the utility pole by pulling on said hand loop.

14. The ladder securing device of claim 13, wherein said main strap member and said buckle strap are constructed of nylon webbing having a width ranging from approximately one to two inches.

15. The ladder securing device of claim 13, wherein said device has a length between approximately 15 and 20 feet and wherein said device has a tensile strength of approximately 1,500 pounds.

16. The ladder securing device of claim 13, wherein said buckle is of the quick release type and having a spring loaded lever mechanism.

17. The ladder securing device of claim 13, wherein said buckle strap and said main strap member each have flexible hook-loops secured thereto for receiving said rigid hooks and whereby the ends of said main strap and said buckle strap are wrapped about the ladder rails and said hooks placed into said respective hook-loops for securing the ladder.

18. The ladder securing device of claim 13 wherein said main strap member and said buckle strap are of an orange color.

19. The ladder securing device of claim 13 wherein said rigid hooks are constructed of a zinc-plated steel.

20. A method for quickly securing a ladder having rails and rungs to a utility pole or the like comprising:

(a) positioning the ladder against the utility pole at an angle;

(b) providing a ladder securing device having a main elongated and flexible planar strap member having looped ends, one said end forming a hand loop for the user of said device, a quick release adjustment buckle having a lever for adjustably engaging said main strap member; an elongated and flexible planar buckle strap having a length substantially shorter than said main strap member and being secured to said buckle at one end and having a loop at its opposite end, and a pair of hooks for engaging the rails of a ladder and having strap securement portions, one said hook being planarly attached at the end of said main strap member opposite said hand loop and the other said hook being planarly attached to said buckle strap at the end opposite said buckle;

(c) releasing said adjustment buckle by activating said lever and pulling said main strap member therethrough and into a fully extended configuration;

(d) placing one said hooks about a rail of the ladder from an interior position so that said hook faces outwardly therefrom;

(e) wrapping said main strap member about the utility pole and extending said other hook toward the opposite rail of the ladder;

(f) placing said other hook about the opposite rail of the ladder and in between the same rungs so that said other hook faces outwardly therefrom;

(g) pulling said hand loop to thereby tighten said main strap; and (h) adjusting the ladder towards the utility pole and pulling said hand loop until equal pressure is placed on both rails of the ladder, whereby the ladder is instantaneously releaseable from securement to the utility pole upon activating said lever of said quick-release buckle.

* * * * *